US005094445A

United States Patent [19]

Winkelvoss

[11] Patent Number: 5,094,445

[45] Date of Patent: Mar. 10, 1992

[54] EXERCISE AND REHABILITATION DEVICE AND METHOD

[75] Inventor: Mark Winkelvoss, New Milford, Conn.

[73] Assignee: 21st Century Anatomy, Inc., Carmel, N.Y.

[21] Appl. No.: 685,156

[22] Filed: Apr. 12, 1991

Related U.S. Application Data

[63] Continuation of Ser. No. 538,844, Jun. 15, 1990, abandoned.

[51] Int. Cl.[5] ..... A63B 23/035

[52] U.S. Cl. ..... 272/63; 272/134; 272/143; 272/144; 128/25 R

[58] Field of Search ..... 272/62, 63

[56] References Cited

U.S. PATENT DOCUMENTS

| | | | |
|---|---|---|---|
| 187,477 | 2/1877 | Medart | 272/63 |
| 195,247 | 9/1977 | Atwater . | |
| 350,932 | 10/1986 | Keating . | |
| 1,984,165 | 12/1934 | Tolchin . | |
| 2,819,132 | 1/1958 | Rock | 128/70 |
| 2,886,028 | 5/1959 | Vogtmann et al. | 128/25 R |
| 3,120,386 | 2/1964 | Janssen | 272/63 |
| 3,390,855 | 7/1968 | Solin | 272/63 |
| 3,731,921 | 5/1973 | Andrew, Jr. . | |
| 3,976,058 | 8/1976 | Tidweil . | |
| 4,332,381 | 6/1982 | Lyons . | |
| 4,354,485 | 10/1982 | Safadago | 128/70 |
| 4,415,150 | 11/1983 | Iezza | 272/63 |
| 4,429,871 | 2/1984 | Flechner | 272/134 |
| 4,566,693 | 1/1986 | Seidentop et al. | 128/71 |
| 4,687,194 | 8/1987 | Good et al. | 272/63 |
| 4,830,367 | 5/1989 | Foran | 272/144 |
| 4,834,072 | 5/1989 | Goodman | 128/25 R |
| 4,861,023 | 8/1989 | Wedman | 272/109 |
| 4,968,025 | 11/1990 | Edkins | 272/63 |

FOREIGN PATENT DOCUMENTS

| | | | |
|---|---|---|---|
| 8901353 | 2/1989 | PCT Int'l Appl. | 128/25 R |

OTHER PUBLICATIONS

"Cinesiologie et Cinesitherapie Generale," by A. LaPierre, J. B. Bailliere et fils, eds, 1962, Paris, p. 938.

"Physical Therapy," by Isadore Brown, *Journal of the American Physical Therapy Association*, Jan. 1970, vol. 50, No. 1, p. 493.

"Gymnastique Therapeutique et Prophylactique Cinesiologie," by A. L. Pecunia, Librairie Maloine S. A., 1962, Paris, p. 323.

(List continued on next page.)

*Primary Examiner*—Richard J. Apley
*Assistant Examiner*—Lynne A. Reichard
*Attorney, Agent, or Firm*—John H. Crozier

[57] ABSTRACT

In one preferred embodiment, a device for strengthening the lower back of a user which includes a frame having a horizontal member for support of the hips of the user and having, spaced apart from the hip support, a horizontal platform for support of the head, shoulders, and upper chest of the user. The user places himself upon the frame so that his hips, head, shoulders, and upper chest are supported, with his legs hanging vertically from the hip support. The chest of the user is largely unsupported to permit comfortable and easy breathing. The strengthening motion comprises raising the legs from the vertical position to the horizontal position and again to the vertical position. There is little or no risk of injury to the vertebral column, due to the fact that the vertebral column is stationary when the exercise is executed. In another preferred embodiment, a hydraulically operated hinged member effects the above leg movement to provide therapy for disabled users. On the upward ascension, the user points his toes downward into plantar flexion, while raising the lower extremities upward. On descension, the toes go into dorsi flexion during the release, while the user exhales.

30 Claims, 5 Drawing Sheets

OTHER PUBLICATIONS

"La Gymnastique Corrective," by Balland and Grozelier, 4th ed., Amedee Legrand & Co., Eds., p. 285.

Partial brochure by Bodymasters, P.O. Box 259, Rayne, La.

Partial brochuree by Polaris, P.O. Box 1458, Spring Valley, Calif.

Partial brochure by Icarian Gym Equipment, 13811 Del Sur Street, San Fernando, Calif.

Partial brochure by Hoggan Health Industries Inc., 111 East 12300 South, Draper Ut.

Partial brochure by Cybex, 2100 Smithtown Avenue, Ronkonkoma, N.Y., May 5, 1989.

Partial brochure by Nautilus, P.O. Drawer 809014, Dallas, Tex.

Article, "The Best Lower Back Exercises" by Michael Yessis, PhD, *Muscle & Fitness,* Jun. 1990, beginning at p. 110.

EXERCISE AND REHABILITATION DEVICE AND METHOD

This is a continuation of co-pending application Ser. No. 07/538,844, filed on June 15, 1990, now abandoned.

BACKGROUND OF THE INVENTION

1. Field of the Invention

The present invention relates generally to exercising devices and, more particularly, to a novel device which provides for strengthening the lower back without twisting or compressing the vertebral column of the user.

2. Background Art

The American Back Society has determined that eight out of ten Americans suffer from some form of lower-back pain. In 1988, the American business community lost about 20 billion dollars because of insurance claims for loss of work, due to back injury and/or pain. In fact, compensation claims involving back problems represented a third of all job related compensation claims paid out by insurance companies that year, and the average back injury compensation claim amounted to $6,000. Treatment for back pain ranges from complicated surgery to a simple drug prescription. However, growing evidence indicates that proper exercise is the best long-term solution for back ailments.

Some back problems can result from hyperextensions occurring during improper physical exercises. Extension of the spine or vertebral column occurs when it is returned to the normal anatomical position from the flexed (bent forward) position. Hyperextension of the spine occurs when the extension movement goes beyond the normal anatomical position (in a backward direction), usually recognized by additional compressing and arching of the spine.

Hyperextensions, and especially excessive hyperextensions, can be dangerous, since compression of the spine is involved. This can lead to fractures of the compressed vertebrae occurring as a result of the forces acting on the back of the person.

Bending incorrectly and lack of strength and flexibility in the muscles that support the spine continues to be a chronic problem. Stress is also a major contributor to back pain, since it causes a tensing and tightening of already weak muscles.

The simplest solution is to strengthen the back by exercise of the muscles of the hip and back. There are two major types of lower back strengthening apparati that are used: (1) hyperextension devices and (2) back extension devices.

When a hyperextension device is used, an individual lies over the device with his face down, bending the torso in the direction of the ground and then subsequently raising the torso. The lower part of the body is kept stationary by a foot attachment. An important part of this exercise is to raise the torso upwardly toward and (improperly) beyond the position parallel to the ground without compressing the spine. However, in view of the design of this apparatus, it is difficult to properly execute this exercise without hyperextension and the resulting substantial compression of the spine. To alleviate this condition, special training of a user such as, for example, rounding out the back so as to eliminate compression of the spine, while performing this exercise, is necessary to ensure correct development of the lower back muscles and to decrease risk of injury to the spine. Lack of such training makes it very difficult for an unconditioned person to use the hyperextension apparatus extensively without substantial risk of injury. Substantial hyperextensions and arching of the back also can bring on, or increase, pressure on the nerves. This can be a factor of back pain and, if the sciatic nerve is impinged, can lead to pain down the legs.

When the back extension machine is used, an individual in the seated position presses on part of the machine with his or her back, so that the upper part of the body goes from a position substantially perpendicular to the lower part of the body to a position in which the whole body is substantially straight. A user of this machine conducts exercises in the seated position while the spine is already compressed. When the back presses on part of the machine, the spine compresses and arches substantially further, especially if the resistance is great. This can lead to excessive compression and shearing forces acting on the vertebrae and disks, injuring the back of a person.

Accordingly, it is a principal object of the present invention to provide an exercise device and method of using the same which can be used to strengthen the lower back of a user without compression, hyperextension, or twisting of the spine of the user.

Another object of the invention is to provide such device and method which are relatively easy and comfortable to use.

An additional object of the invention is to provide such a device that is readily adjusted to accommodate users of different sizes.

A further object of the invention is to provide such a device that is easily and economically constructed.

Other objects of the present invention, as well as particular features and advantages thereof, will be elucidated in, or be apparent from, the following description and the accompanying drawing figures.

SUMMARY OF THE INVENTION

The present invention achieves the above objects, among others, by providing, in one preferred embodiment, a device for strengthening the lower back of a user which includes a frame having a horizontal member for support of the hips of the user and having, spaced apart from the hip support, a horizontal platform for support of the head, shoulders, and upper chest of the user. The user places himself upon the frame so that his hips, head, shoulders, and upper chest are supported, with his legs hanging vertically from the hip support. The chest of the user is largely unsupported to permit comfortable and easy breathing. The strengthening motion comprises raising the legs from the vertical position to the horizontal position and again to the vertical position. There is little or no risk of injury to the vertebral column, due to the fact that the vertebral column is stationary when the exercise is executed. In another preferred embodiment, a hydraulically operated hinged member effects the above leg movement to provide therapy for disabled users.

BRIEF DESCRIPTION OF THE DRAWING

Understanding of the structure of the present invention and its various features will be facilitated by reference to the accompanying drawing figures, in which.

DETAILED DESCRIPTION OF THE PREFERRED EMBODIMENTS

Figure 1:
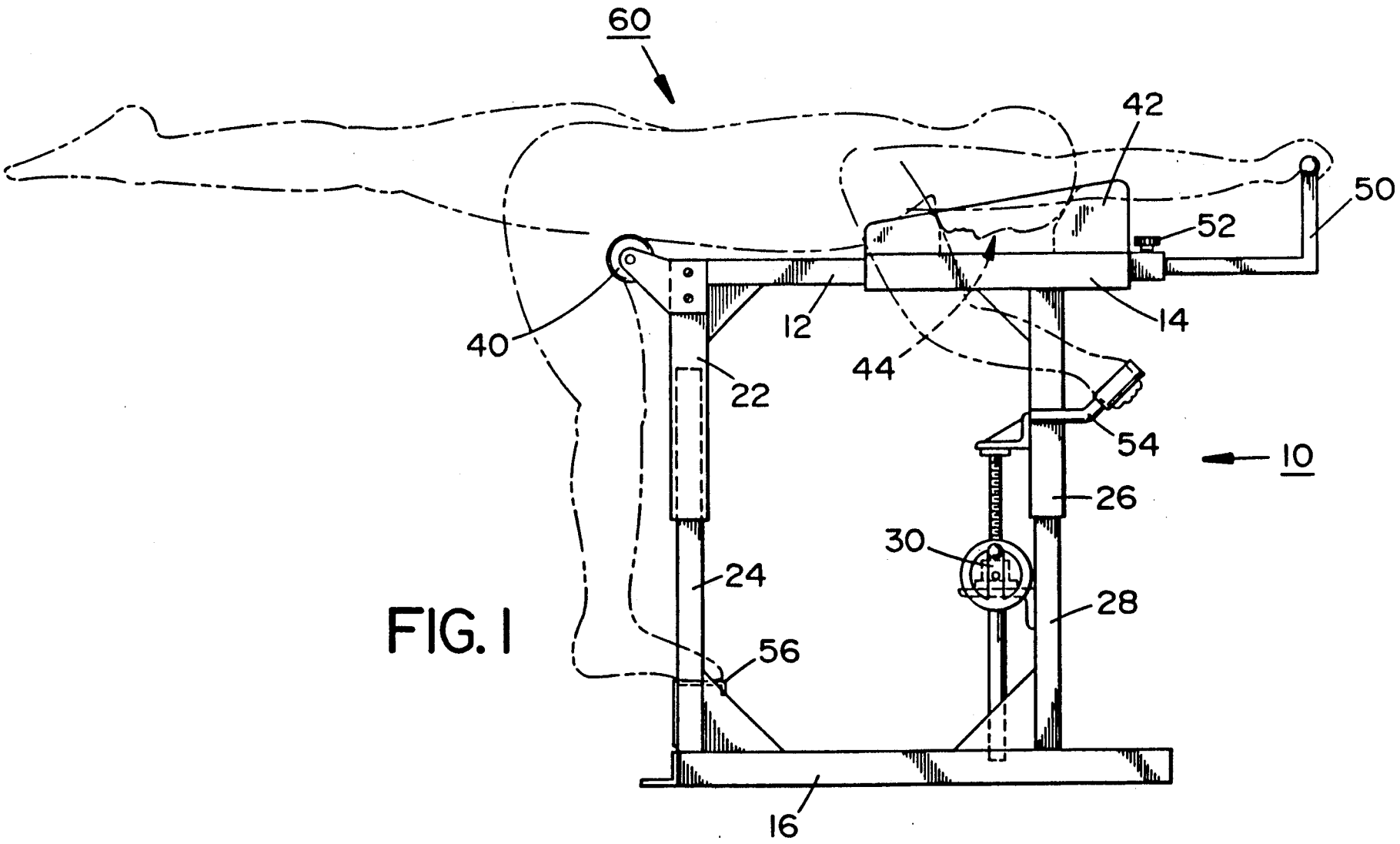
FIG. 1 is a side elevation view of one embodiment of the present invention with a user thereon.

Referring now to the Drawing, in which the same or similar elements are given consistent identifying numerals throughout the various figures thereof, FIG. 1 depicts a device for use in strengthening the lower back, constructed according to the present invention, generally indicated by the reference numeral 10, with a user thereon.

Device 10 includes an upper horizontal frame member 12 having a support platform 14 freely movable fore and aft thereon. Device 10 further includes a lower horizontal frame 16 for support of said device on a floor or like supporting surface. Upper frame 12 is mounted on a first pair of telescoping legs having upper sections 22 fixedly attached to the upper frame and a lower sections 24 fixedly attached to lower frame 14. A similar, second pair of telescoping legs having upper sections 26 and lower sections 28 movably joins upper horizontal frame member 12 to lower horizontal frame 16. The height of upper frame 12 and support platform 14 from lower horizontal frame 16 is selectively adjusted by means of a conventional worm gear mechanism 30.

It will be understood that, for purpose of this description and the appended claims, the term "front" and formations thereof refer to that portion of device 10 near or where upper sections 26 are disposed and that the term "rear" and formations thereof refer to that portion of the device near or where upper sections 22 are disposed.

Fixedly and horizontally disposed at the rear of upper horizontal frame 12 is a rounded, cushioned hip support 40 generally disposed somewhat rearwardly of upper leg sections 22, so that device 10 can accomodate users with large thighs.

Figure 2:
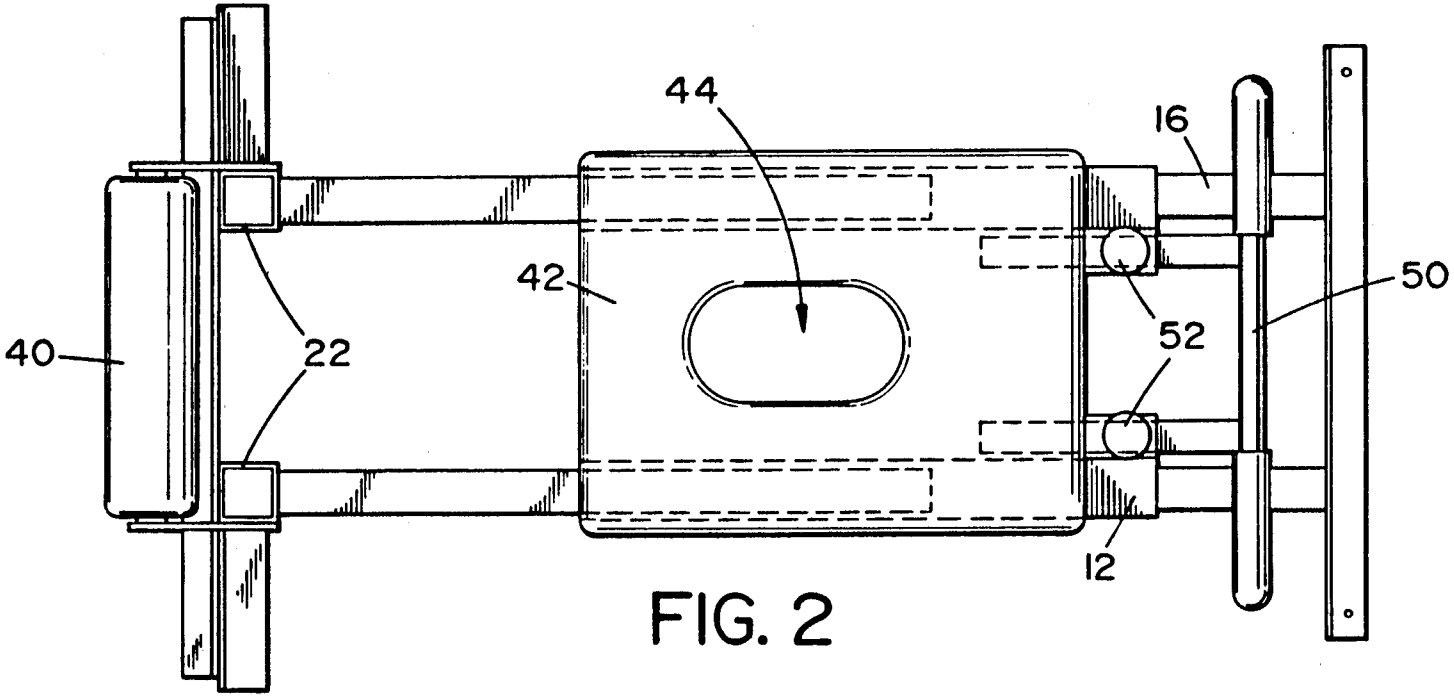
FIG. 2 is a top plan view of the device of FIG. 1 showing the supporting members of the device.
Figure 3:
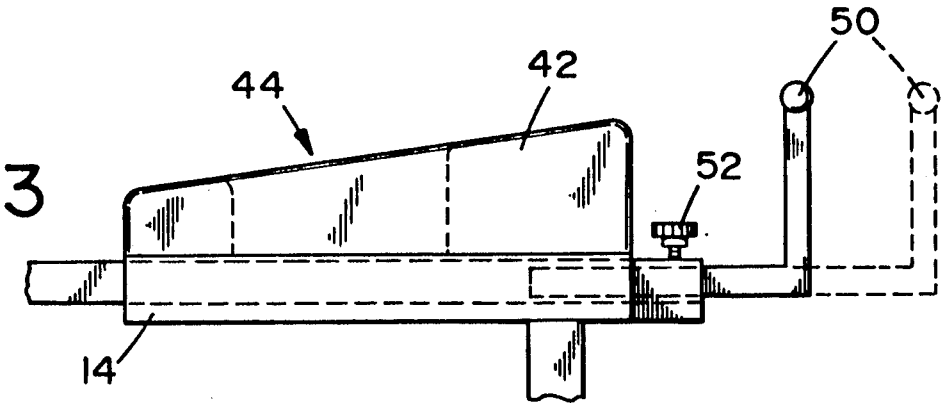
FIG. 3 is a fragmentary side elevation view of the elements of the device shown on FIG. 2.
Figure 4:
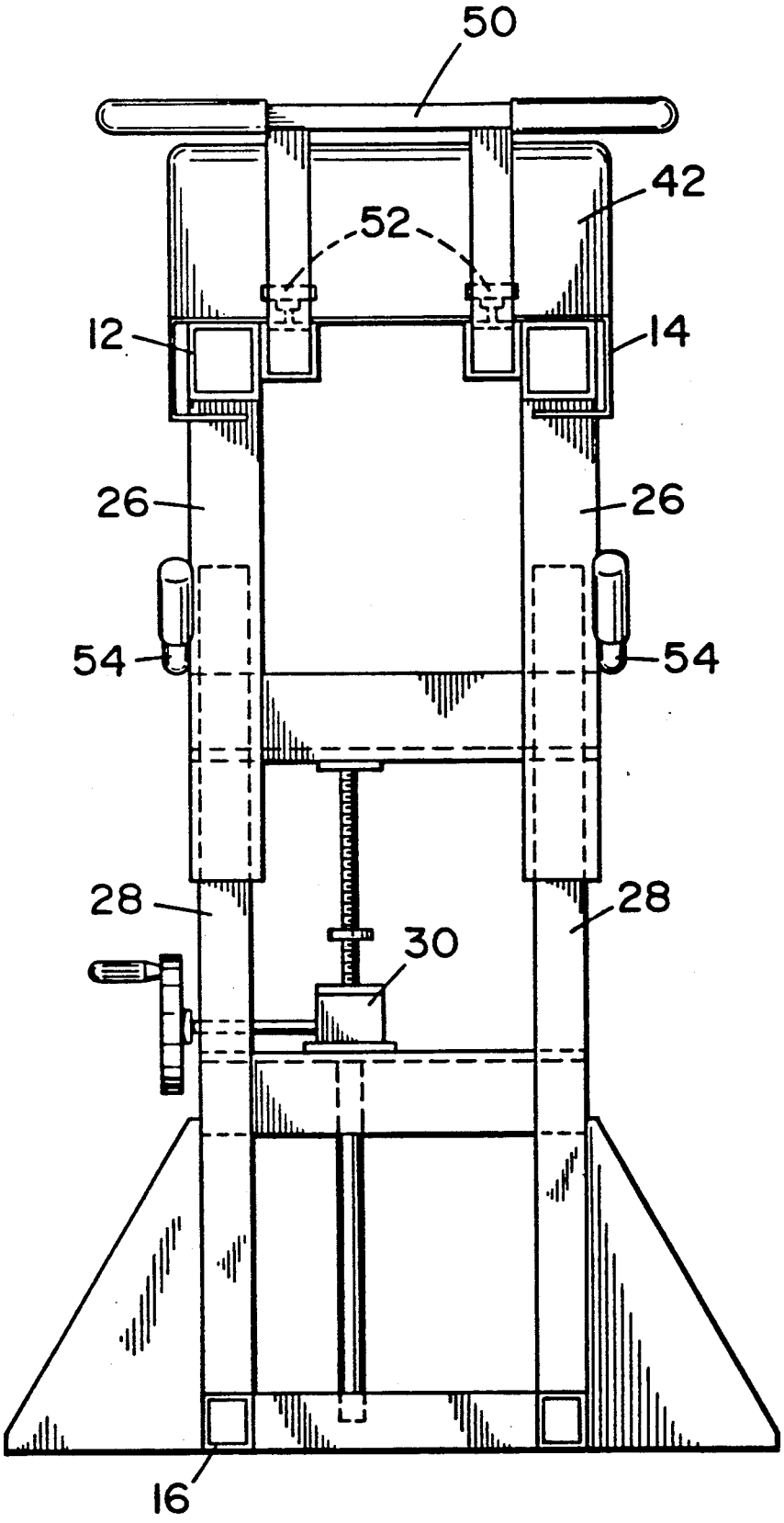
FIG. 4 is a front elevation view of the device of FIG. 1.

Referring also to FIGS. 2 and 3, support platform 14 includes a resilient pad 42 fixed thereon, the pad having an oval opening 44 formed therethrough, and the pad sloping from a high point at the forward end of the pad to a low point at the rear end of the pad. Attached to the forward end of upper horizontal frame member 12 is an adjustable hand grip structure 50 telescopingly extending forwardly of the member and selectively fixed in position by means of hand screws 52. Referring particularly again to FIG. 1, fixed hand grips 54 (only one visible on FIG. 1) are attached to upper leg sections 26 as shown.

Completing the description of the major elements of device 10, there is provided a horizontal foot stand 56 fixedly attached at the lower ends of lower leg sections 24.

In use, the user, generally identified by the reference numeral 60, steps upon foot stand 56 and bends over hip support 40 to the position shown on FIG. 1, with the central portion of the user's face inserted into oval opening 44. Placing the face in oval opening 44 assists in proper orientation of user 60 on device 10, as well as providing comfortable support for the head of the user. While moving to the position shown, the user may find it convenient to grasp fixed hand grips 54, but while using device 10 for back strengthening, the user may find it more comfortable to grip adjustable hand grip structure 50 forward of the user's head. Since the length of the legs and the length of the torso will vary from user to user, depending on age, sex, etc., mechanisms 30 and 32 will be adjusted for the comfort of each user. Hip support 40 will be adjusted high enough that the feet of the user can be easily slid off foot stand 56.

Once positioned as shown, the user is supported at the hips by hip support 40. The shoulders, clavicular area, and face of the user are supported by resilient pad 42, while additional support of the upper chest may be provided by sternum support 46. Thus positioned, the lower portion of the user's chest is unsupported, permitting comfortable and easy breathing. Furthermore, in the position shown, the whole vertebral column is stationarily positioned and is in correct, natural alignment and curvature, without compression thereof and the back muscles are relaxed when the feet are in a downward pointing position. Because of the bent position of the user's body, the lower back muscles, which are to be strengthened during the exercise, are somewhat isolated from the rest of the back muscles. The gripping of hand grip structure 50 or of fixed hand grips 54 helps stabilize the position of the upper torso of user 60 during exercise.

When the back strengthening exercise begins, the user inhales and raises the lower extremities to a position substantially parallel to the ground, as shown in broken lines on FIG. 1. On upward ascension of the lower extremities, the user preferably points the toes downward into plantar flexion. On descension, the toes preferably go into dorsi flexion during the release, while the user exhales.

When performing the exercise, the user's chest freely expands and contracts within the unrestricted area between hip support 40 and platform 14, thus permitting the user to breathe easily and freely. Such breathing ensures an adequate supply of oxygen to the lungs, eliminates discomfort, and helps the user to exercise efficiently. Having support platform 14 movably disposed on horizontal frame member 12 permits movement thereon during the exercise, thus affording user 66 a high degree of comfort and further assuring that the vertebral column is neither expanded nor compressed.

Figure 5:
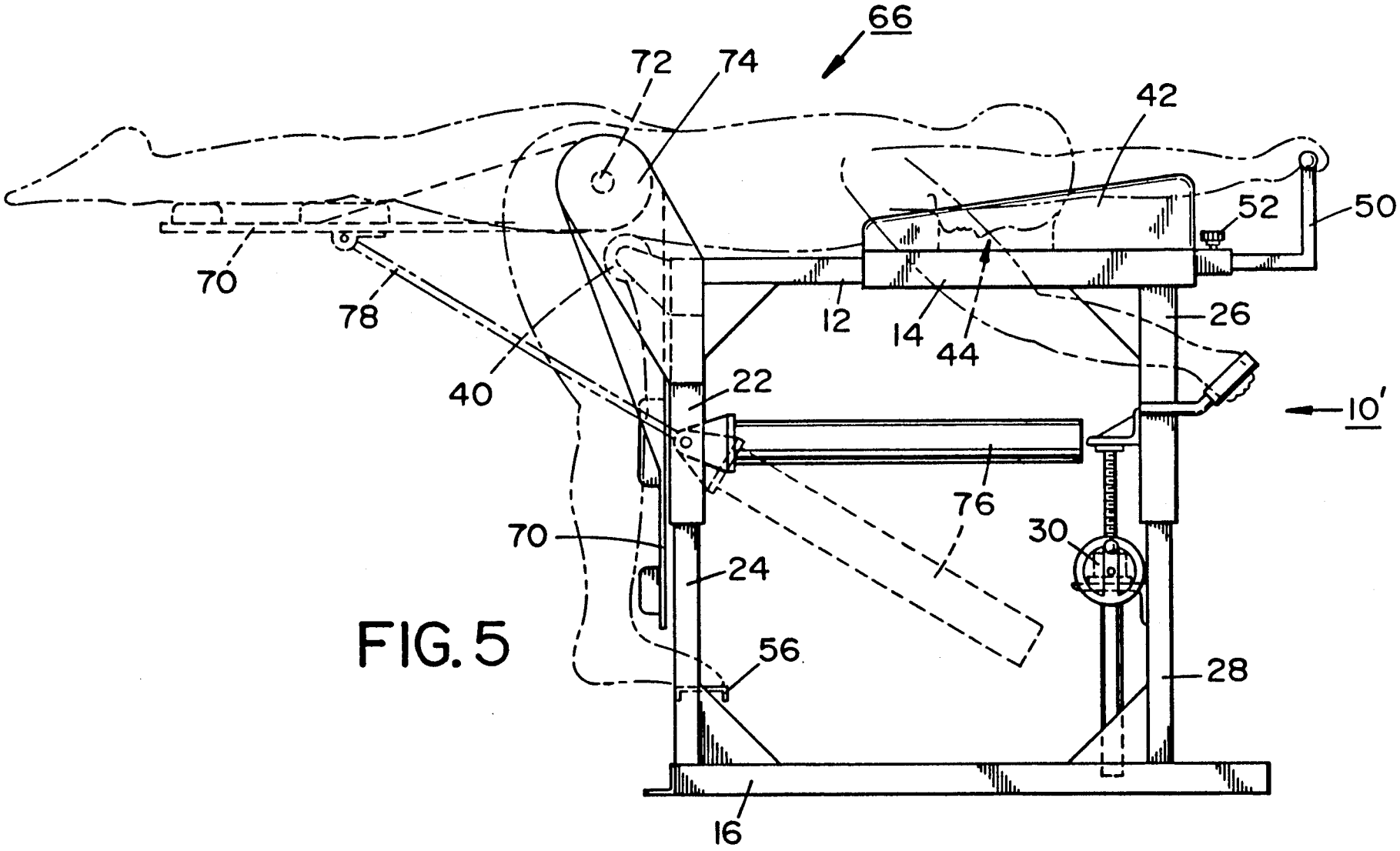
FIG. 5 is a side elevation view of another embodiment of the present invention with a user thereon.

FIG. 5 depicts device 10 modified for use in physical rehabilitation programs where injury or illness has seriously limited the range of movement of the body, or its strength, with respect to muscles of the lower back and hip, the modified device being identified generally by the reference numeral 10'. Device 10' includes a leg support 70 rotatable about a shaft 72, the shaft being fixedly attached to device 10' by means of flange 74 on the right side of device 10'. It will be understood that an identical shaft and a flange (neither shown) are provided on the left side of device 10'. Leg support 70 is rotated by means of a conventional hydraulic cylinder 76 having its distal end rotatably attached between upper leg sections ZZ, with its shaft 78 extendable to rotate the leg support from its vertical position (solid lines) to its horizontal position (broken lines), thus raising the legs of the patient. The controls for hydraulic cylinder 76 are conventional and may be arranged so that either patient 66 or an attendant can operate the cylinder. The controls may provide for selectively adjusting the speed and/or extent of rotation of leg support 70.

When device 10' is used in a rehabilitation program, careful attention must be given to the prevention of over-extension of the lower back muscles which may have been subject to disease or injury. The process of exercising must not be permitted to aggravate the original condition.

In order to use device 10' for rehabilitation purposes, patient 66 is placed on the apparatus in the position similar to that shown, which is identical to that of user 60 shown on FIG. 1. To raise the legs, hydraulic cylinder 76 is activated to gradually lift leg support 70. After leg support 70 reaches a predetermined elevation, the direction of motion of the mechanism is reversed and the legs are gradually lowered to the initial position. Such exercise can be repeated with different speeds of motion and different degrees of elevation of the legs.

In order to have control over the intensity of a rehabilitation program, the hydraulic controls can be adjusted to vary the level of support provided by leg support 70 to the legs. For example, leg support 70 can provide the lifting force to move only 50 percent of the weight of the patient's legs, the remaining 50 percent of the required force being provided through exercise of the patient's own muscles. The level of support provided by the regulating mechanism is usually greater at the initial stages of rehabilitation and can be reduced as the condition of the patient improves.

During the rehabilitation exercise, the lower extremities of a physically impaired person are moved upwardly into a hip extension to manipulate the muscle groups of the gluteal and lower back. The regulating mechanism associated with the leg support 70 enables the patient to raise and lower his or her legs with different degrees of assistance.

Figure 6:
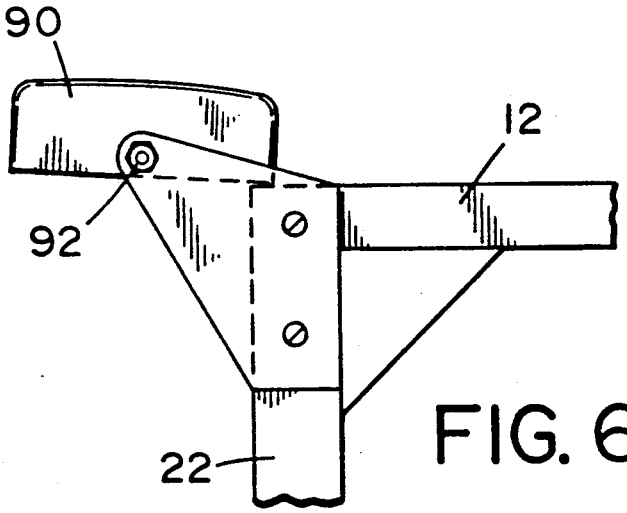
FIGS. 6 and 7 are fragmentary side elevation views and FIG. 8 is a top plan view of an alternative hip support for use with the present invention.
Figure 7:
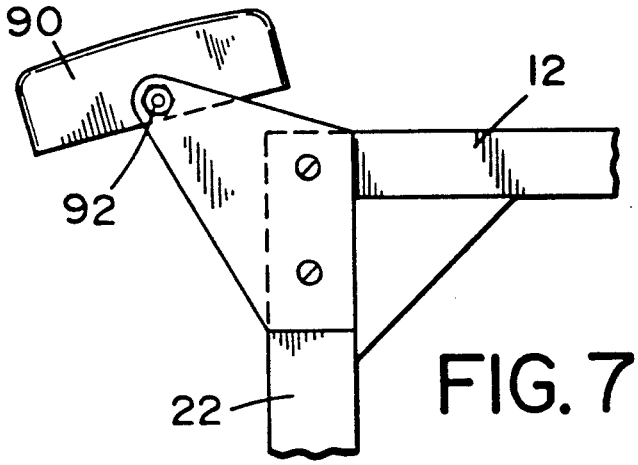
Figure 8:
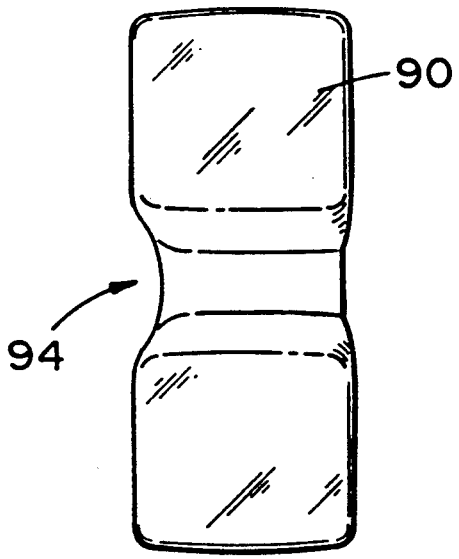

FIGS. 6–8 illustrate an alternative hip support 90 which may be employed with devices 10 and 10'. Hip support 90 is a generally rectilinear padded member which is disposed rearwardly of upper sections 22 and which is disposed on a shaft 92 to permit a slight amount of rotational motion as is indicated by comparing the relative positions of hip support 90 on FIGS. 6 and 7. Thus, hip support 90 affords a somewhat greater degree of support and comfort than does hip support 40 shown on FIGS. 1, 2, and 5. Hip support 90 includes a cut-out portion 94 for the increased comfort of male users.

Devices 10 and 10' of the present invention facilitate extensions of the lower back and hip areas versus extensions of the upper torso. This is a substantially safer exercise than those disclosed by the prior art, since possibility of hyperextension or compression of the vertebral column is substantially reduced, if not totally eliminated It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An exercise and rehabilitation device for the lower back of a user, comprising:

(a) a frame member;

(b) spaced apart clavicle and hip support members supported by said frame member, said clavicle and hip support members being spaced apart by approximately the distance between the frontal area of the shoulders and clavicle of the user and the frontal area of the hips of the user, with no support member(s) between said clavicle and hip support members;

(c) a substantially unrestricted area defined between said clavicle and hip support members to accommodate therein, unsupported, the lower chest of the user when the user lies face down on said device;

(d) said clavicle support member comprising a pad with an opening defined through said pad to receive the face of the user and being adapted to support the front area of the shoulders and clavicle of the user when the user lies face down on said device; and (e) said hip support member being adapted to support the frontal area of the hips of the user when the user lies face down on said device;

whereby, during use of said exercise device, a user lying face down on said clavicle and hip support members raises his legs from a declined position to an elevated position.

2. An exercise and rehabilitation device, as defined in claim 1, wherein the distance between said clavicle and hip support members is adjustable.

3. An exercise and rehabilitation device, as defined in claim 1, further comprising means to selectively adjust the heights of said first and second support members.

4. An exercise and rehabilitation device, as defined in claim 1, wherein said pad slopes from a high point at the front thereof to a low point at the rear thereof.

5. An exercise and rehabilitation device, as defined in claim 1, wherein said hip support member is generally rounded.

6. An exercise and rehabilitation device, as defined in claim 1, wherein said hip support member is generally rectilinear.

7. An exercise and rehabilitation device, as defined in claim 1, wherein said hip support member is rotatable.

8. An exercise and rehabilitation device, as defined in claim 1, further comprising a pair of hand grips disposed below said clavicle support member.

9. An exercise and rehabilitation device, as defined in claim 1, further comprising a hand grip structure disposed forward of said clavicle support member.

10. An exercise and rehabilitation device, as defined in claim 1, further comprising a foot stand to assist said user in mounting said device.

11. An exercise and rehabilitation device for the lower back of a user, comprising:

(a) a frame member;

(b) spaced apart clavicle and hip support members supported by said frame member, said clavicle and hip support members being spaced apart by approximately the distance between the frontal area of the shoulders and clavicle of the user and the frontal area of the hips of the user, with no support member(s) between said clavicle and hip support members;

(c) a substantially unrestricted area defined between said clavicle and hip support members to accommodate therein, unsupported, the lower chest of the user when the user lies face down on said device;

(d) said clavicle support member comprising a pad with an opening defined through said pad to receive the face of the user and being adapted to support the frontal area of the shoulders and clavicle of the user when the user lies face down on said device;

(e) said hip support member being adapted to support the frontal area of the hips of the user when the user lies face down on said device;

(f) a rotating leg support to raise the legs of the user; and (g) controls to selectively control the speed of said rotating leg support;

whereby, during use of said exercise device, a user lying face down on said clavicle and hip support members has his legs raised from a declined position to an elevated position by said rotating leg support.

12. An exercise and rehabilitation device, as defined in claim 11, further comprising controls to selectively control the extent of travel of said rotating leg support.

13. An exercise and rehabilitation device, as defined in claim 11, further comprising controls to selectively control the degree of force provided by said rotating leg support.

14. A method for a person to exercise or rehabilitate the lower back, comprising the steps of:

(a) providing spaced apart clavicle and hip support members supported by a frame member, with a substantially unrestricted area defined between said clavicle and hip support members to accommodate therein, unsupported, the lower chest of said person when said person lies face down on said device, said clavicle support member being adapted to support the frontal area of the shoulders and clavicle of the person when the person lies face down on said device, and said hip support member being adapted to support the frontal area of the hips of the person when the person lies face down on said device, said clavicle and hip support members being spaced apart by approximately the distance between the frontal area of the shoulders nd clavicle of the person and the frontal area of the hips of the person, with no support member(s) between said clavicle and hip support members;

(b) the person lying face down on said clavicle and hip support members, with his shoulders and clavicular area supported by said clavicle support member, with his hips supported by said hip support member, with his lower chest unsupported, and with his legs in a declined position; and (c) the person raising his legs from a declined position to an elevated position.

15. A method, as defined in claim 14, further comprising the step of providing said first and second support members such that the distance therebetween is adjustable.

16. A method, as defined in claim 14, further comprising the step of providing said first and second support members such that the heights thereof are selectively adjustable.

17. A method, as defined in claim 14, further comprising the step of providing said first support member having:

(a) a resilient pad; and (b) an opening defined through said pad to receive the face of said user.

18. A method, as defined in claim 17, further comprising the step of providing said pad sloping from a high point at the front thereof to a low point at the rear thereof.

19. A method, as defined in claim 14, further comprising the step of providing second support member having a generally rounded shape.

20. A method, as defined in claim 14, further comprising the step of providing second support member having a generally rectilinear shape.

21. A method, as defined in claim 14, further comprising the step of providing said second member being rotatable.

22. A method, as defined in claim 14, further comprising the step of providing a pair of hand grips disposed below said first support member.

23. A method, as defined in claim 14, further comprising the step of providing a hand grip structure disposed forward of said first support member.

24. A method, as defined in claim 14, further comprising the step of providing a foot stand to assist said user in mounting said device.

25. A method, as defined in claim 14, further comprising the step of providing a rotating leg support to raise the legs of said user.

26. A method, as defined in claim 25, further comprising the step of providing controls to selectively control the speed of said rotating leg support.

27. A method, as defined in claim 25, further comprising the step of providing controls to selectively control the extent of travel of said rotating leg support

28. A method, as defined in claim 25, further comprising the step of providing controls to selectively control the degree of force provided by said rotating leg support.

29. An exercise and rehabilitation device for the lower back of a user, comprising:

(a) a frame member;

(b) spaced apart first and second support members supported by said frame member;

(c) a substantially unrestricted area defined between said first and second support members to accommodate therein, unsupported, the lower chest of said user when said user lies face down on said device;

(d) said first support member being adapted to support at least the shoulders and clavicular area of said user when said user lies face down on said device;

(e) said second support member being adapted to support at least the hip area of said user when said user lies face down on said device; and (f) said first support member comprising a pad sloping from a high point at the front thereof to a low point at the rear thereof and an opening defined through said pad to receive the face of said user whereby, during use of said exercise device, a user lying face down on said first and second support members raises his legs from a declined position to an elevated position.

30. A method for a person to exercise the lower back, comprising the steps of:

(a) providing spaced apart first and second support members supported by a frame member, with a substantially unrestricted area defined between said first and second support members to accommodate therein, unsupported, the lower chest of said person when said person lies face down on said device, said first support member being adapted to support at least the shoulders and clavicular area of said person when said person lies face down on said device, and said second support member being adapted to support at least the hip area of said person when said person lies face down on said device;

(b) said person lying face down on said first and second support members, with his shoulders and clavicular area supported by said first support member, with his hips supported by said second support member, with his lower chest unsupported, and with his legs in a declined position;

(c) said person raising his legs from a declined position to an elevated position; and (d) further comprising the step of providing said first support member as a resilient pad sloping from a high point at the front thereof to a low point at the rear thereof and having an opening defined therethrough to receive the face of said user.

* * * * *